US006827592B2

(12) United States Patent
McCoy et al.

(10) Patent No.: US 6,827,592 B2
(45) Date of Patent: Dec. 7, 2004

(54) TRACK-TYPE ELECTRICAL DISTRIBUTION SYSTEM

(75) Inventors: Phillip A. McCoy, Albion, IN (US); Donald E. DeWitt, Syracuse, IN (US)

(73) Assignee: Pent technologies, Inc., Kendallville, IN (US)

( * ) Notice: Subject to any disclaimer, the term of this patent is extended or adjusted under 35 U.S.C. 154(b) by 107 days.

(21) Appl. No.: 10/222,712

(22) Filed: Aug. 16, 2002

(65) Prior Publication Data

US 2003/0036306 A1 Feb. 20, 2003

Related U.S. Application Data

(60) Provisional application No. 60/313,265, filed on Aug. 17, 2001.

(51) Int. Cl.[7] ..... H01R 25/00
(52) U.S. Cl. ..... 439/118; 439/120
(58) Field of Search ..... 439/110, 115, 439/118, 120, 121

(56) References Cited

U.S. PATENT DOCUMENTS

| | | | | |
|---|---|---|---|---|
| 2,924,804 | A | 2/1960 | Frank et al. | 339/21 |
| 3,676,830 | A | 7/1972 | Donato | 339/21 |
| 4,181,388 | A | 1/1980 | Donato | 339/21 |
| 4,289,365 | A | 9/1981 | Rutgers | 339/21 |
| 4,494,808 | A | 1/1985 | Widell et al. | 448/803 |
| 4,533,190 | A | 8/1985 | Booty | 339/21 |
| 4,749,358 | A | 6/1988 | Soleanski | 439/119 |
| 4,790,766 | A | 12/1988 | Booty, Sr. et al. | 439/122 |
| 4,825,540 | A | 5/1989 | Kelly | 29/861 |
| 5,046,963 | A | 9/1991 | Kelly | 439/211 |
| 5,127,842 | A | 7/1992 | Kelly | 439/165 |
| 5,174,647 | A | 12/1992 | Kelly | 362/221 |
| 5,582,520 | A | 12/1996 | Doudon | 439/106 |
| 5,619,014 | A | 4/1997 | Faulkner | 174/68.2 |
| 5,759,051 | A | 6/1998 | Cancellieri et al. | 439/118 |

*Primary Examiner*—Khiem Nguyen
(74) *Attorney, Agent, or Firm*—Taylor & Aust, P.C.

(57) ABSTRACT

An electrical distribution system includes a track having a longitudinal extension and a facia. The facia has an elongate slot extending generally parallel with the longitudinal extension. The slot includes a plurality of elongate side channels extending transversely from and generally parallel to the longitudinal extension. The track includes a plurality of electrical conductors, with each electrical conductor being positioned within a corresponding side channel. The plurality of electrical conductors include at least one data conductor. A modular electrical component includes a male connector extending therefrom which is disposed within the slot. The male connector includes a plurality of electrical terminals extending therefrom, with each electrical terminal disposed within a corresponding channel and electrically coupled with a corresponding conductor. The male connector is rotatable within the slot and includes a rotation restriction only allowing rotation of the male connector within the slot in one direction.

11 Claims, 7 Drawing Sheets

TRACK-TYPE ELECTRICAL DISTRIBUTION SYSTEM

This application claims the benefit of Provisional Application No. 60/313,265, filed Aug. 17, 2001.

BACKGROUND OF THE INVENTION

1. Field of the Invention

The present invention relates to electrical distribution systems, and, more particularly, to modular track-type electrical distribution systems.

2. Description of the Related Art

An electrical distribution system used in conjunction with modular office furniture typically consists of a plurality of electrical distribution harnesses which are respectively associated with wall panels, work surfaces, etc. The wiring harnesses include end connectors which are coupled together using jumper cables. Each wiring harness also typically includes one or more output connectors which are used for coupling with a modular electrical component, such as an electrical receptacle or the like. Each output connector generally is in the form of a single roll of terminals having ports which are keyed to allow connection with only a particular type of electrical component. For example, a particular keying configuration for mating connectors may ensure that only a particular one of multiple circuits within the wiring harness is connected with.

Electrical distribution systems including wiring harnesses and jumper cables as described above provide electrical break outs at pre-determined locations within the piece of modular furniture with which it is used. However, it is not typically possible to easily adjust the break out locations for modular electrical components such as electrical receptacles, lights, etc.

Track-type electrical distribution systems are known in which an extruded track has a facia with a plurality of slots extending therein. Each separate slot carries a single conductor bar. An electrical component, such as an electrical receptacle, includes multiple different projections which are respectively received within the multiple slots. Each projection electrically couples with a corresponding conductor bar in the different slots. Although such track type distribution systems effectively provide power to a modular electrical component, the multiple different slots and corresponding projections may be relatively complicated to manufacture. Further, with many of these track-type distribution systems, there are no provisions to ensure that the modular electrical component is correctly coupled with the conductor bars (e.g., so as to prevent coupling with reverse polarity).

Electrical distribution systems as described above using a wiring harness and jumper cable arrangement in modular office furniture may be positioned within a raceway in the furniture. A raceway may be provided with a wiring trough allowing additional power cables and/or data cables to be routed therethrough. Data conductors are not incorporated into the wiring harness itself. Moreover, track-type electrical distribution systems as described above are only used for transmitting power to modular electrical components such as an electrical receptacle. Track-type electrical distribution systems as described above are not used for transmitting data, such as with a phone system or computer system.

What is needed in the art is a track-type electrical distribution system which does not allow coupling of modular electrical components with the track in a reverse polarity manner, and which allows the system to be used for electrical power and/or data distribution.

SUMMARY OF THE INVENTION

The present invention provides a track-type electrical distribution system having conductors which transmit power and/or data, and modular electrical components which are keyed to couple with the track in a manner preventing improper electrical coupling.

The invention comprises, in one form thereof, an electrical distribution system including a distribution track having a longitudinal extension and a facia. The facia has an elongate slot extending generally parallel with the longitudinal extension. The slot includes a plurality of elongate side channels extending transversely from and generally parallel to the longitudinal extension. The track includes a plurality of electrical conductors, with each electrical conductor being positioned within a corresponding side channel. The plurality of electrical conductors include at least one data conductor. A modular electrical component includes a male connector extending therefrom which is disposed within the slot. The male connector includes a plurality of electrical terminals extending therefrom. Each electrical terminal is disposed within a corresponding channel and electrically coupled with a corresponding conductor.

The invention comprises, in another form thereof, an electrical distribution system including a track having a longitudinal extension and a facia. The facia has an elongate slot extending generally parallel with the longitudinal extension. The slot includes a plurality of elongate side channels extending transversely from and generally parallel to the longitudinal extension. The track includes a plurality of electrical conductors, with each electrical conductor being positioned within a corresponding side channel. A modular electrical component includes a male connector extending therefrom which is disposed within the slot. The male connector includes a plurality of electrical terminals extending therefrom, with each electrical terminal disposed within a corresponding channel and electrically coupled with a corresponding conductor. The male connector is rotatable within the slot and includes a rotation restriction only allowing rotation of the male connector within the slot in one direction.

An advantage of the present invention is that the modular electrical components can only be connected with the track in a predetermined orientation.

Another advantage is that the track system can be used to transmit electrical power and/or data.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
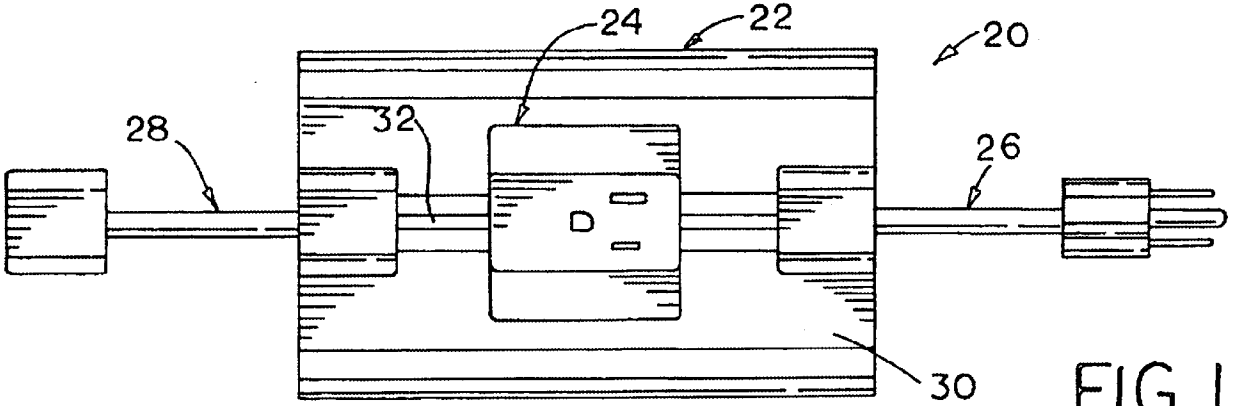
FIG. 1 is a top view of an embodiment of a track-type electrical distribution system of the present invention.
Figure 2:
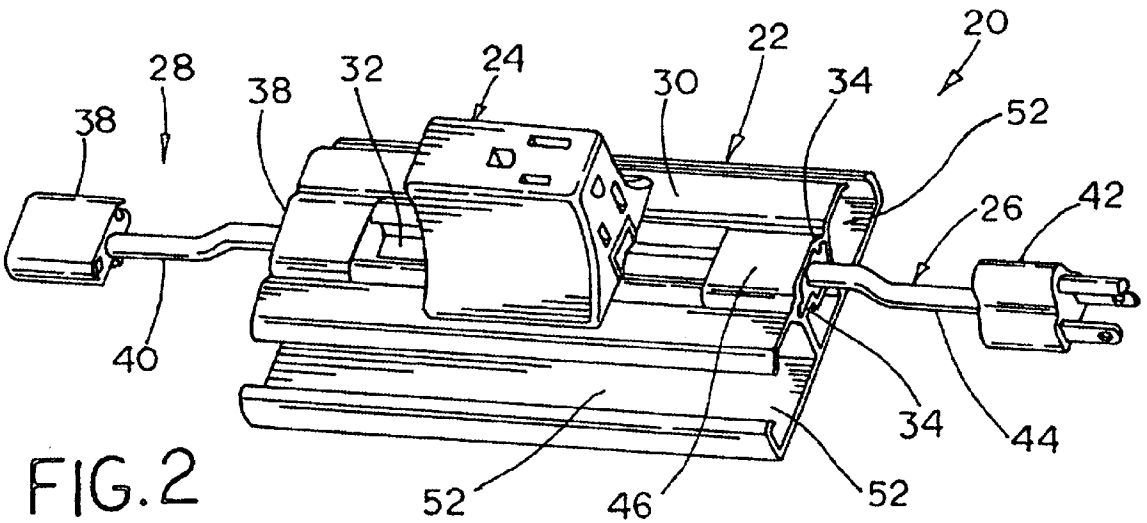
FIG. 2 is a perspective view of the track-type electrical distribution system shown in FIG. 1.
Figure 3:
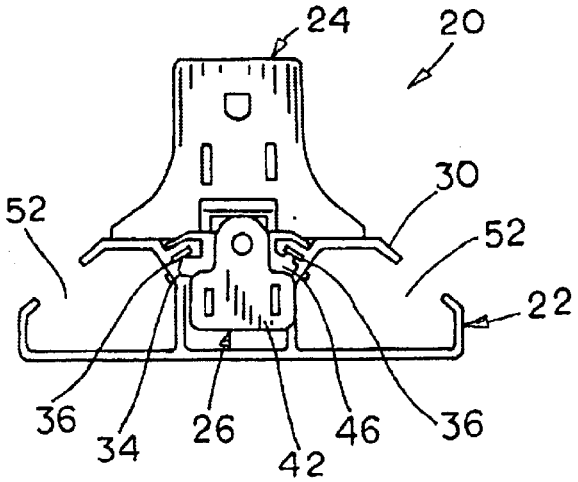
FIG. 3 is an end view of the track-type electrical distribution system shown in FIGS. 1 and 2.
Figure 4:
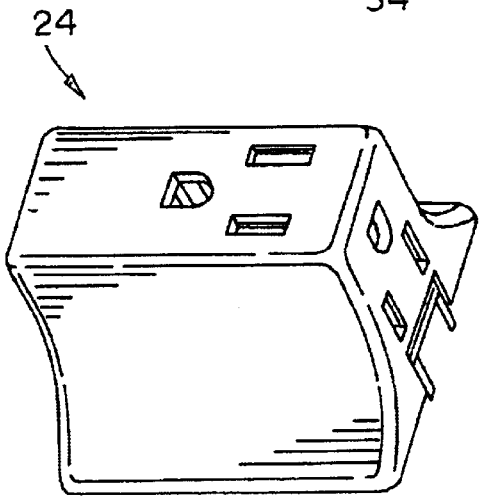
FIG. 4 is a perspective view of the electrical receptacle shown in FIGS. 1–3.
Figure 5:
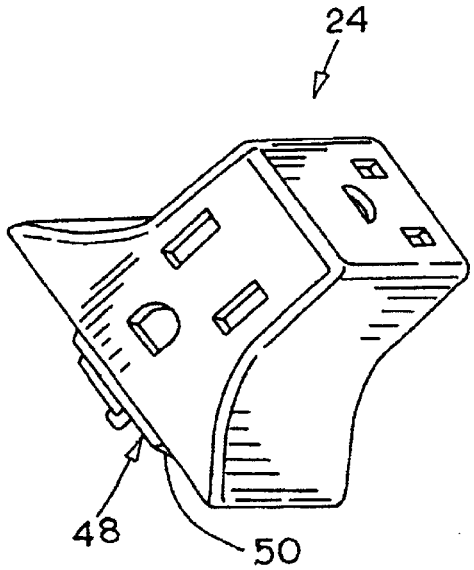
FIG. 5 is another perspective view of the electrical receptacle shown in FIGS. 1–4.

Referring now to the drawings, and more particularly to FIGS. 1–3, there is shown an embodiment of a track-type electrical distribution system 20 of the present invention. Electrical distribution system 20 generally includes a distribution track 22, modular electrical component 24, power feed cable 26, and jumper cable 28.

Distribution track 22 has a longitudinal extension and a facia 30. An elongate slot 32 extends inwardly from facia 30 and is positioned generally parallel with the longitudinal extension of track 22. Slot 32 includes a plurality of side channels 34 (e.g., two side channels 34 in the embodiment shown) which extend transversely from and generally parallel to the longitudinal extension of track 22. In other words, slot 32 includes a main portion extending inwardly from facia 30, and a plurality of connected channels which extend transversely from the main portion, but parallel with the longitudinal extension. Track 22 also includes a pair of longitudinally extending wire troughs 52 allowing power and/or data cables to be run therein.

A plurality of electrical conductors 36 are respectively positioned within each side channel 34. Electrical conductors 36 are in the form of relatively rigid conductor bars which are placed within respective side channels 34. Electrical conductor bars 36 are formed from a highly conductive material, such as copper, aluminum, etc.

Jumper cable 28 includes a pair of end connectors 38 which are each configured with a size and shape generally corresponding to the interior dimensions of slot 32 and side channels 34. End connectors 38 are electrically coupled together with a flexible electrical cable 40 having a plurality of electrical conductors therein. Each end connector 38 of jumper cable 28 is configured to be received within slot 32, and electrically coupled with electrical conductors 36 within side channels 34.

Power feed cable 26 includes a three-prong male plug 42 suitable for coupling with conventional 115 volt household electrical power. Male plug 42 is connected via electrical cable 44 with end connector 46. End connector 46, similar to end connectors 38 of jumper cable 28, is configured with a size and shape to be received within slot 32 and electrically couple with electrical conductors 36. Electrical power received at male plug 42 thereby is transmitted to electrical conductors 36 within track 22.

Figure 6:
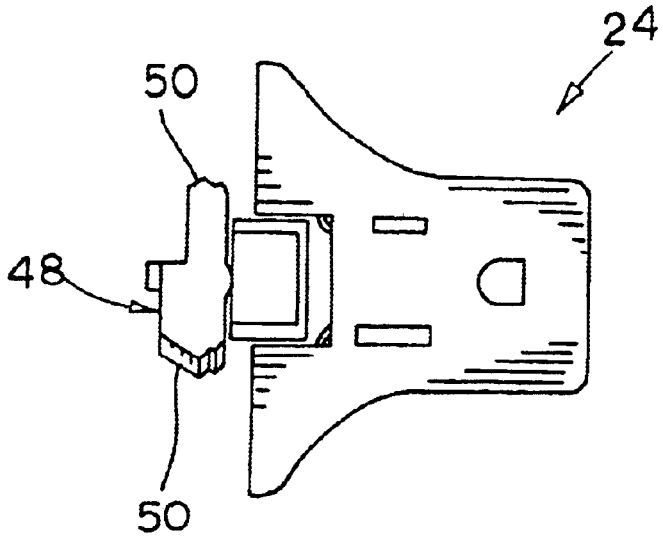
FIG. 6 is an end view of the electrical receptacle shown in FIGS. 1–5.
Figure 7:
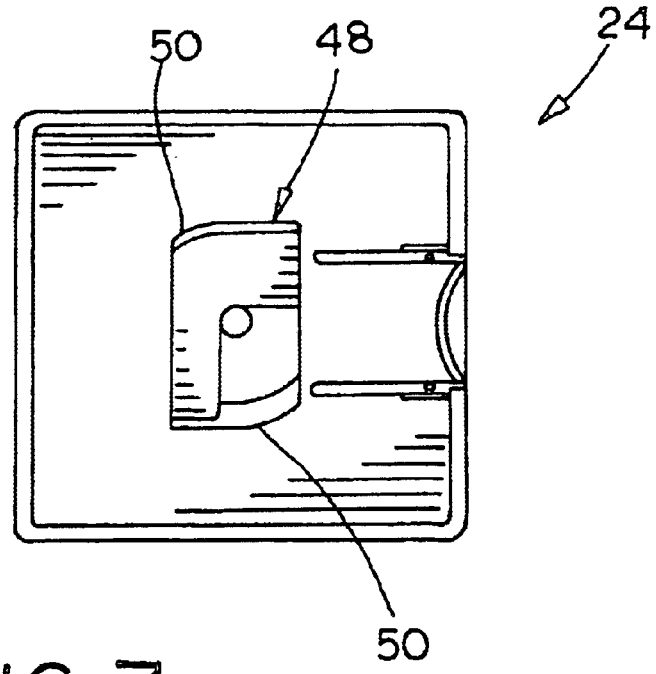
FIG. 7 is a bottom view of the electrical receptacle shown in FIGS. 1–6.

Modular electrical component 24 is in the form of a multiple outlet receptacle in the embodiment shown. Modular electrical component 24 includes three simplex receptacles on adjoining flat faces thereof. The simplex receptacles are coupled together in parallel with each other. Modular electrical component 24 includes a male connector 48 extending therefrom. Male connector 48 is disposed within slot 32 for mechanically and electrically coupling with slot 32 and electrical conductors 36, respectively. More particularly, referring to FIGS. 6 and 7, male connector 48 includes a pair of ramped surfaces 50 which extend in a lateral direction therefrom. Ramped surfaces 50 are positioned in a staggered relationship relative to each other to be received within corresponding side channels 34 within slot 32. Ramped surfaces 50 define a rotation restriction which only allows rotation of male connector 48 (and thus electrical component 24) within slot 32 in a single direction. Ramped surfaces 50 thereby prevent improper electrical coupling of modular electrical component 24 with electrical conductors 36. For example, ramped surfaces 50 prevent electrically coupling modular electrical component 24 to electrical conductors 36 with a reversed polarity.

Figure 8:
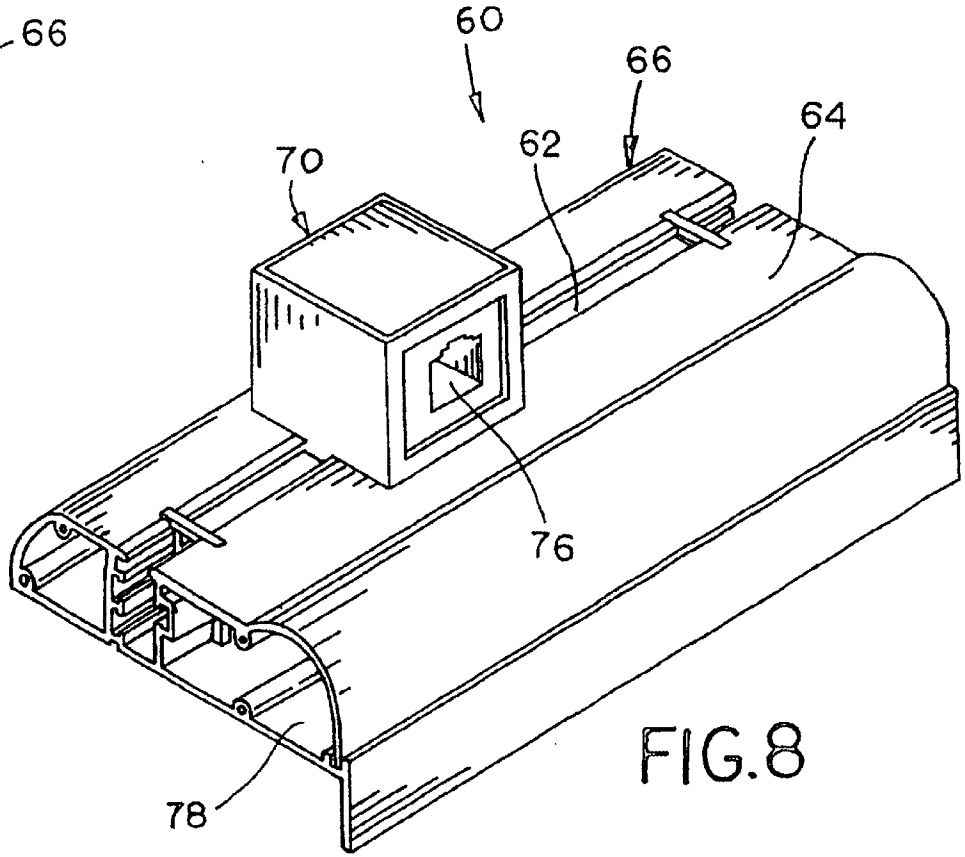
FIG. 8 is a perspective view of another embodiment of a track-type electrical distribution system of the present invention.
Figure 9:
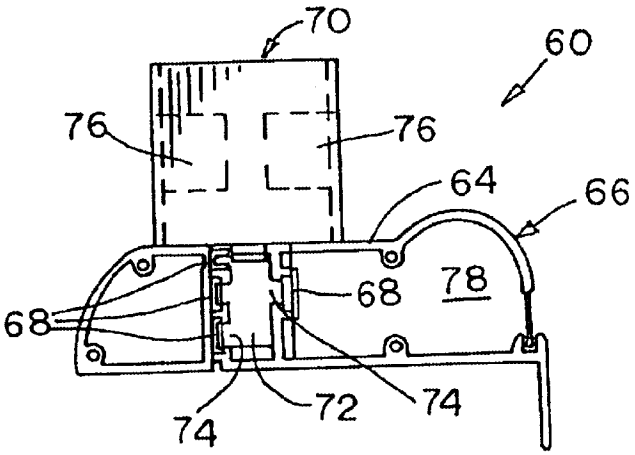
FIG. 9 is end view of the track-type electrical distribution system shown in FIG. 8.
Figure 13:
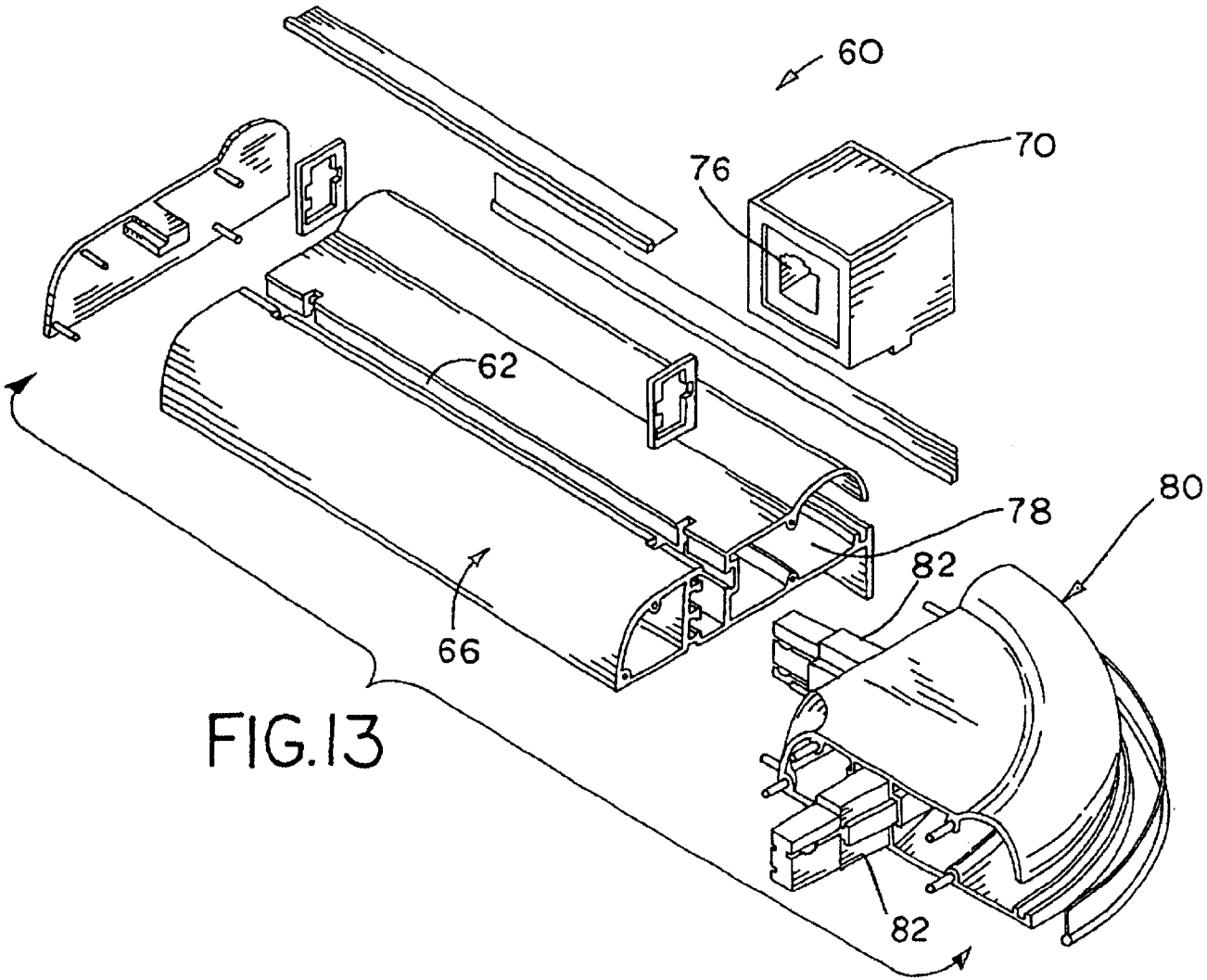
FIG. 13 is an exploded, perspective view of the track-type electrical distribution system shown in FIGS. 8 and 9.

FIGS. 8 and 9 illustrate yet another embodiment of a track-type electrical distribution system 60 of the present invention. Similar to electrical distribution system 20 described above, electrical distribution system 60 includes a slot 62 extending inwardly from a facia 64 of track 66. Slot 62 includes a plurality (namely, four in the embodiment shown) side channels 68, each having an electrical conductor bar (not numbered) therein. Track 66 also includes an accessible wiring trough 78 allowing power and/or data cables to be run therein. FIG. 13 is an exploded, perspective view of the embodiment of track-type electrical distribution system 60.

Modular electrical component 70 is in the form of an RJ-style data jack for coupling with a telephone, computer or the like. Modular electrical component 70 includes a male connector 72 which is received within slot 62. Male connector 72 includes a plurality of electrical terminals 74 extending therefrom which respectively electrically couple with the electrical conductor bars within side channels 68. The four electrical terminals 74 which are coupled with the electrical conductor bars within side channel 68 are distributed at one pair per RJ-style plug 76. All four of the electrical terminals 74 and electrical conductor bars are used for transmitting data to RJ-style plugs 76.

A corner track piece 80 (FIG. 13) includes a pair of outwardly extending electrical connectors 82 positioned generally orthogonal to each other. Electrical connectors 82 are configured with a size and shape to mechanically couple with slot 62 and electrically couple with the electrical conductors within each side channel 68. Corner track piece 80 therefore electrically and mechanically interconnects adjacent track pieces 66 at a corner. Of course, it will be appreciated that the straight track portion 66 or 22 may likewise be configured with integral connectors such as connectors 82 rather than using jumper cables such as jumper cables 28.

Figure 10:
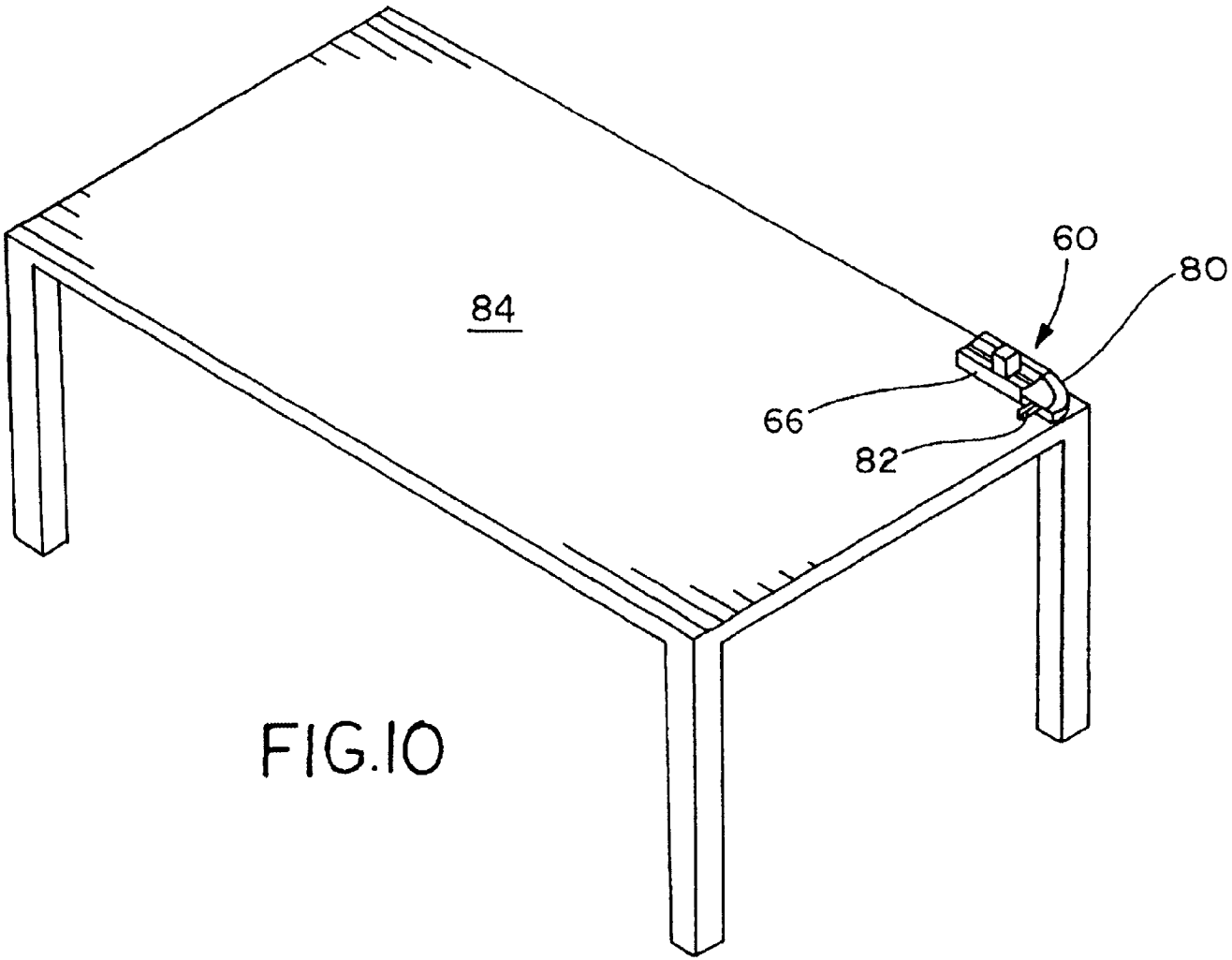
FIG. 10 is a perspective view of a work surface carrying a portion of the electrical distribution system shown in FIGS. 8 and 9.

FIG. 10 illustrates placement of a track-type electrical distribution system 60 with respect to a work surface in the form of a table 84. For simplicity sake, only a single section of track 66 and a corner piece 80 are illustrated overlying table 84.

Figure 12:
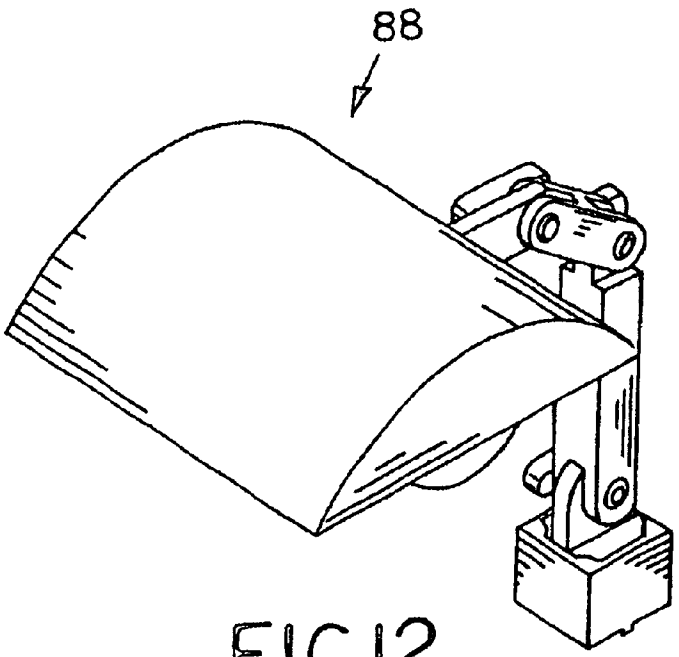
FIG. 12 is a perspective view of a light used in a track-type electrical distribution system of the present invention.
Figure 11:
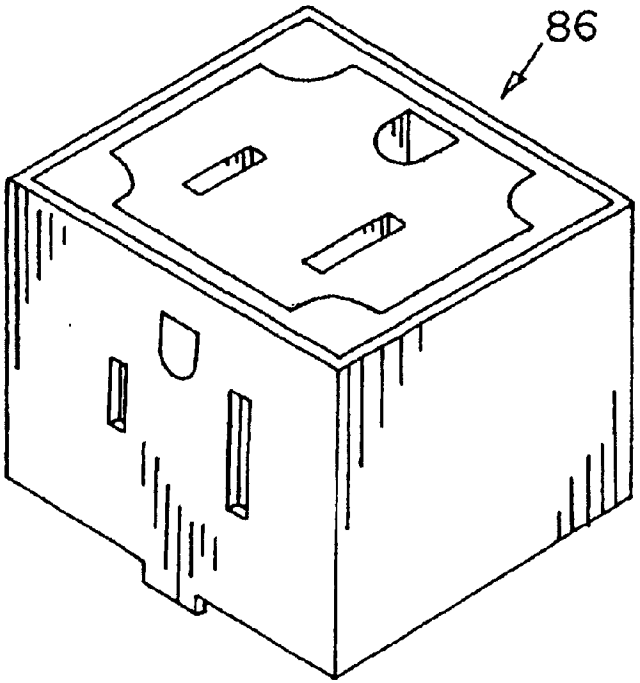
FIG. 11 is a perspective view of another embodiment of an electrical receptacle used in a track-type electrical distribution system of the present invention.

FIGS. 11 and 12 illustrate other types of modular electrical components 86 and 88 which may be coupled with a particular track configuration. Modular electrical component 86 is in the form of an electrical receptacle having an exterior shape which is different from the embodiment shown in FIGS. 4–7. Modular electrical component 88 is in the form of a fluorescent light which may be coupled with power conductors within side channels in a track. Regardless of the particular type of modular electrical component used, each particular configuration is preferably constructed such that the male connector extending therefrom which is received within the slot of the track can only be rotated in one direction, thereby preventing incorrect electrical coupling between the modular electrical component and the electrical conductors carried within the slot of the track. For example, any selected type of modular electrical component may be formed with ramped surfaces such as shown by ramped surfaces 50 in FIGS. 6 and 7.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical distribution system, comprising:

a distribution track having a longitudinal extension and a facia, said facia having an elongate slot extending generally parallel with said longitudinal extension, said slot including a plurality of elongate side channels extending transversely from and generally parallel to said longitudinal extension, said track including a plurality of electrical conductors, each said electrical conductor being positioned within a corresponding said side channel, said plurality of electrical conductors including at least one data conductor; and a modular electrical component including a male connector extending therefrom, said male connector disposed within said slot, said male connector including a plurality of electrical terminals extending therefrom, each said electrical terminal disposed within a corresponding said channel and electrically coupled with a corresponding said conductor.

2. The electrical distribution system of claim 1, wherein each said electrical conductor comprises a conductor bar.

3. The electrical distribution system of claim 1, wherein said track has a substantially uniform cross section.

4. The electrical distribution system of claim 1, wherein each said channel has a rectangular cross sectional shape.

5. The electrical distribution system of claim 1, wherein said plurality of electrical conductors include a plurality of data conductors.

6. The electrical distribution system of claim 1, wherein each said electrical conductor is a data conductor.

7. An electrical distribution system, comprising:

a distribution track having a longitudinal extension and a facia, said facia having an elongate slot extending generally parallel with said longitudinal extension, said slot including a plurality of elongate side channels extending transversely from and generally parallel to said longitudinal extension, said track including a plurality of electrical conductors, each said electrical conductor being positioned within a corresponding said side channel; and a modular electrical component including a male connector extending therefrom, said male connector disposed within said slot, said male connector including a plurality of electrical terminals extending therefrom, each said electrical terminal disposed within a corresponding said channel and electrically coupled with a corresponding said conductor, said male connector being rotatable within said slot and including a rotation restriction only allowing rotation of said male connector within said slot in one direction.

8. The electrical distribution system of claim 7, wherein said rotation restriction comprises at least one ramped surface extending in a lateral direction from said male connector, each said ramped surface positioned within a corresponding said side channel.

9. The electrical distribution system of claim 8, wherein said male connector comprises a pair of ramped surfaces staggered in a longitudinal direction along said male connector.

10. The electrical distribution system of claim 9, wherein each said ramped surface includes a corresponding said electrical terminal extending therefrom.

11. The electrical distribution system of claim 8, wherein said modular component comprises one of an electrical receptacle, a light and a data jack.

* * * * *